US006003590A

United States Patent [19]

Pavlicevic et al.

[11] Patent Number: 6,003,590

[45] **Date of Patent: *Dec. 21, 1999**

[54] CONTINUOUS CASTING METHOD AND RELATIVE DEVICE

[75] Inventors: Milorad Pavlicevic, Udine; Alfredo Poloni, Fogliano di Redipuglia; Nuredin Kapaj, Udine; Andrea Codutti, Moruzzo, all of Italy

[73] Assignee: Danieli & C. Officine Meccaniche SpA, Buttrio, Italy

[ * ] Notice: This patent is subject to a terminal disclaimer.

[21] Appl. No.: 08/855,451

[22] Filed: May 13, 1997

[30] Foreign Application Priority Data

May 13, 1996 [IT] Italy ..... UD96A0075

[51] Int. Cl.[6] ..... B22D 27/02

[52] U.S. Cl. ..... 164/468; 164/504; 164/478

[58] Field of Search ..... 164/468, 466, 164/502, 504, 498, 499, 500, 478, 416, 147.1

[56] References Cited

U.S. PATENT DOCUMENTS

| | | |
|---|---|---|
| 4,522,249 | 6/1985 | Mulcahy . |
| 4,867,786 | 9/1989 | Saeki et al. . |
| 4,933,005 | 6/1990 | Mulcahy et al. . |

FOREIGN PATENT DOCUMENTS

| | | |
|---|---|---|
| 489202 | 6/1992 | European Pat. Off. . |
| 511465 | 11/1992 | European Pat. Off. . |
| 2632549 | 12/1989 | France . |
| 8001999 | 10/1980 | WIPO . |
| 9415739 | 7/1994 | WIPO . |

OTHER PUBLICATIONS

Patent Abstracts of Japan, vol. 6No. 1 (M–105) [879] Jan. 7, 1982 & JP–A–56 126048 (Mitsubishi) Oct. 2, 1981—abstract.

Patent Abstracts of Japan vol. 5 No. 76 (M–69) [748] May 20, 1981 & JP–A–56 026661 (Shin Nippon) Mar. 14, 1981)—abstract.

*Primary Examiner*—Kuang Y Lin

*Attorney, Agent, or Firm*—Antonelli, Terry, Stout & Kraus, LLP

[57] ABSTRACT

Device for the continuous casting of billets, blooms, slabs and round bars, the device being associated with a crystalliser (10) containing the cast metal, the crystalliser (10) having sidewalls (11) which cooperate with cooling channels (16–24) defined by outer walls (15), the device comprising a plurality of devices located outside the sidewalls (11) of the crystalliser, the electromagnetic devices (18*a*, 18*b*, 18*c*) cooperating directly with the sidewalls (11) and being spaced apart longitudinally along the direction of sliding of the cast product, and fed in an independent, separate and differentiated manner from each other, the feeding being a function of the generation of a pulsating electromagnetic field in a direction substantially perpendicular to the axis of the crystalliser (10) and migrating substantially along the whole longitudinal extent of the crystalliser (10), the current pulses achieving a value of up to 100 kA. In the method, the solidified skin of the cast metal inside the crystalliser (10) undergoes the action of a pulsating magnetic field in a direction substantially perpendicular to the axis of the crystalliser (10) and migrating lengthwise substantially along the whole extent of the crystalliser (10), the magnetic field being generated by a plurality of electromagnetic devices (18*a*, 18*b*, 18*c*) spaced apart longitudinally along the extent of the crystalliser (10) and fed in an independent and differentiated manner from each other, with current pulses which achieve a value of up to 100 kA.

20 Claims, 4 Drawing Sheets

CONTINUOUS CASTING METHOD AND RELATIVE DEVICE

BACKGROUND OF THE INVENTION

This invention concerns a continuous casting method with a magnetic field and the relative device.

The invention is applied to machines performing continuous casting of billets, blooms and slabs and, in particular, thin slabs in the field of the production of iron and steel.

The state of the art of the continuous casting field covers the use of electromagnetic devices associated externally with the sidewalls of a crystalliser and able to generate an electromagnetic field interacting with the molten metal being cast.

In the state of the art this electromagnetic field mainly has the purpose of improving the surface quality of the product and/or of increasing the casting speed by taking action on the parameters of formation of the layer of solid skin and by causing to happen earlier a separation of the skin from the sidewalls of the crystalliser; another purpose is to displace the surface of the molten metal in the zone of the joint between the refractory material and the crystalliser so that the solidification begins only in the crystalliser and there are no leakages of material.

The electromagnetic devices of the state of the art normally comprise a coil or one single inductor positioned in cooperation with the outside of the wall of the crystalliser and generally close to the zone of the beginning of solidification of the metal.

Embodiments have been disclosed in which the coil or inductor generates a stationary alternating magnetic field (see the article "Improvement of Surface Quality of Steel by Electromagnetic Mold" taken from the documents of the International Symposium on the "Electromagnetic Processing of Materials"—Nagoya 1994) or else generates an alternating magnetic field modulated in amplitude (see the article "Study of Meniscus Behavior and Surface Properties During Casting in a High-Frequencies Magnetic Field" taken from "Metallurgical and Materials Transaction"—Vol.26B, April 1995).

Other embodiments disclosed provide for the magnetic field generated to be periodically pulsating with waves defined by successions of pulses of a substantially constant amplitude (U.S. Pat. No. 4,522,249) or else for the magnetic field to be generated by electromagnetic waves of a development which is attenuated until it is eliminated within a half-period (SU-A-1021070 and SU-A-1185731).

To be more precise, the teaching disclosed in U.S. Pat. No. 4,522,249 includes a helical coil wound around the crystalliser along its whole lengthwise extent.

This helical coil is fed by means of a pulsating direct current of from 10 to 100 Ms, an amplitude of between 5 and 20 kA, a frequency of repetition of around 1 $KH_Z$. The current generates radial forces which act on the crystalliser in order to make it vibrate. The vibration serves to eliminate the mechanical oscillation and tends to improve the surface quality of the product.

The action of vibration induced on the crystalliser may cause, and indeed does cause, breakages due to fatigue; moreover, the vibration is not able to act on the product with actions of the migrating field type or multi-modal excitations, which are those that obtain an effective usable result.

WO-A-80/01999 and FR-A-2.632.549 include electromagnetic devices consisting of radially arranged poles on which the coils are wound; the devices are arranged at different levels and are made to function in a staggered manner.

The coils are fed with alternate current, low frequency mono-phase or multi-phase, and they generate forces which are mainly directed in an azimuthal direction and only by reflection in a lengthwise direction along the axis of the crystalliser.

These electromagnetic devices have the function of mixing in an azimuthal direction the liquid steel in the crystalliser in such a way as to produce a helical motion either upwards or downwards.

U.S. Pat. No. 4,933,005 includes permanent coils or magnets operating both in correspondence with the meniscus and in a desired zone of the crystalliser. The coils arranged along the crystalliser, and far from the meniscus, generate mainly azimuthal forces (azimuthal stirring) or helical forces (helical stirring) or longitudinal forces (longitudinal stirring); the coils arranged in correspondence with the meniscus generate forces which oppose the movement of the liquid part of the product.

The coils placed far from the meniscus serve to move the liquid part of the product so as to obtain the known metallurgical results deriving from electromagnetic stirring. The coils which cooperate with the meniscus serve as an electromagnetic brake in order to reduce the consequential distorsions caused to the meniscus by the electromagnetic stirring generated by the other coils, and also to reduce the turbulence caused by the introduction of material into the crystalliser.

EP-A-0.511.465 discloses a coil for electromagnetic stirring which can be displaced along the axis of the crystalliser, in such a way that it is possible to adapt the electromagnetic stirring effect in the liquid metal according to the different metallurgical requirements.

EP-A-0.489.202 provides for coils which cooperate with the crystalliser and fed with direct current; they generate a constant magnetic field with the appropriate direction. These coils serve to brake the liquid steel which leaves the submerged discharge nozzle so as to prevent the scouring of the already solidified skin and at the same time to reduce the trapping of the slag.

U.S. Pat. No. 4,867,786 and JP-A-56.126.048 provide for coils which produce azimuthal flows so as to mix the liquid part of the metal with a stirring effect in an azimuthal direction, in order to obtain the desired stirring effects.

WO-A-94.15739 discloses two traditional coils for electromagnetic stirring, of which one is located on the meniscus.

Both coils are fed with low frequency, multi-phase alternating current, possibly with different intensities of current; the direction of the magnetic field migrating over the pole pieces may also be different.

The forces generated are applied on the liquid part of the product in an azimuthal direction.

The function of the underlying coil is to provide for the azimuthal stirring of maximum intensity; the function of the coil on the meniscus is to contrast the distorsion produced on the meniscus by the stirring effected by the first coil or, alternatively, to increase the effect on the meniscus according to the particular type of process or the type of casting (type of steel).

Experimental tests have shown that the configurations of the electromagnetic field acting in the crystalliser, in the state of the art as described above, are not suitable to achieve the results desired by the Proprietor of this invention, in view of the different conditions which take place within the solidifying metal.

These different conditions, which are due to the different physical state and different temperature of the solidifying metal, cause an interaction between the magnetic field and the metal, this interaction being different from one zone to another of the crystalliser and therefore not being the best along the whole length of the crystalliser. In particular, but not only, the state of the art does not allow to fulfil the following functions in a positive manner:

- to reduce the friction between the cast product and the crystalliser by inducing pulsating forces directly onto the solid skin of the product, and also onto the liquid part where that is necessary, in order to increase the casting speed;
- not to use the traditional methods of mechanical oscillation of the ingot mold, with a consequent improvement of the surface quality of the product, as the oscillation marks are eliminated;
- to control the effect on the meniscus according to the requirements of processing, so as to improve both the lubrification of the area of contact between the skin and the sidewall of the crystalliser, and also the surface quality and the inner quality of the product;
- to use the capacity of resonance of the solidified skin and the skin-liquid system, so as to improve the heat exchange performed in the mushy zone in order to encourage a growth of the product with an equal axis, and a consequent improvement in the inner quality;
- to use the migrating field configuration in order to induce, in the liquid part, a vertical stirring (direction of the axis of the crystalliser) so as to obtain an optimum effect;
- to improve the heat exchange in the lower part of the crystalliser where the skin is separated from the crystalliser, thus increasing the total quantity of heat extracted by the crystalliser and making it possible to achieve higher casting speeds and improvements in the quality of the product.

SUMMARY OF THE INVENTION

The present applicants have designed, tested and embodied this invention to overcome all these shortcomings and to achieve all the advantages described above.

This invention achieves a method and the relative device for the continuous casting of billets, blooms, slabs or round bars, the method and device employing the generation of a pulsating magnetic field migrating along the lengthwise extent of the crystalliser. The purpose of the invention is to fulfil at least the following functions in a positive manner:

- to reduce the friction between the cast product and the crystalliser by inducing pulsating forces directly onto the solid skin of the product, and onto the liquid part where that is necessary, in order to increase the casting speed;
- not to use the traditional systems of mechanical oscillation of the ingot mold, and therefore the crystalliser, with a consequent improvement in the surface quality of the product as the oscillation marks are eliminated;
- to control the effect on the meniscus according to the requirements of processing, so as to improve both the lubrification and the surface and inner quality of the product;
- to exploit the capacity of resonance of the solidified skin and the skin-liquid system, in order to improve the heat exchange in the mushy zone so as to encourage a growth of the product with an equal axis and a consequent improvement in the inner quality of the continuously cast product;
- to use the migrating field configuration in order to induce in the liquid part a vertical stirring (direction of the axis of the crystalliser) so as to obtain an optimum result in the cast product;
- to improve the heat exchange in the lower part of the crystalliser where the skin is separated from the crystalliser, thus increasing the total quantity of heat extracted by the crystalliser and making it possible to achieve greater casting speeds and at the same time to improve the quality of the product.

The invention also makes it possible to achieve other purposes and functions, as will become clear hereinafter.

According to the invention the sidewalls of the crystalliser are directly associated with a plurality of single electromagnetic devices arranged longitudinally distanced from each other, in a position outside the crystalliser itself, and fed independently of each other.

In a preferred embodiment of the invention the single electromagnetic devices, whether coils or inductors, are controlled by one single assembly suitable to feed those devices with parameters of intensity and of timing of the current and with parameters of form of the pulse which are different from each other but are correlated and controlled so as to achieve the general and particular effect desired, even zone by zone.

According to the invention this lay-out makes possible a suitable variation of the parameters and characteristics of feed of each single device and thereby the relative electromagnetic forces generated.

According to a first form of embodiment, the electromagnetic devices arranged in cooperation with the crystalliser are the same as each other.

According to a variant, the electromagnetic devices are conformed differently from each other according to the different conditions of use required; for example, the devices may include a different number of windings from each other or may include different cooling systems.

These electromagnetic devices are suitable to generate electromagnetic forces which interact with the inside of the crystalliser and which have at least one component of desired intensity oriented in a substantially perpendicular manner to the axis of the crystalliser; the component may be directed towards the inside or the outside.

According to the invention these electromagnetic forces vary in time within a period according to the conformation of the wave generated by the electromagnetic device.

According to the invention, these forces are variable also in distance along the length of the crystalliser according to the arrangement and different lay-out and feed of the electromagnetic devices.

This arrangement and the reciprocal independence of the electromagnetic devices according to the invention enables a system with magnetic pulses of a multi-phase type to be obtained along the crystalliser.

By staggering suitably the action of these devices in a fixed manner or in a variable manner in time or by switching-off alternatively one or the other of these devices it is possible to set in vibration the cast product by exciting it locally.

In a preferred, but not restrictive, solution of the invention the frequencies of excitation of the molten metal are those which substantially correspond to the frequencies of resonance; they are different at different points on the crystalliser according to the specific physical state and specific temperature of the metal.

For instance, the frequency of resonance of the metal when the latter includes at the same time a liquid phase and a solid phase is between about 10 and 30 KHz, while the frequency of resonance of the solidified skin is between about 1 and about 10 KHz, and the frequency of oscillation of the free surface for the liquid part is between about 5 and about 70 KHz.

By getting as close as possible to, or even surpassing, the condition of resonance of the cast product in the crystalliser along the whole longitudinal extent thereof an amplitude of the vibrations and an intensity of the electromagnetic forces acting on the solid skin are obtained which are much greater than those which can be obtained with an electromagnetic device of the known type, given an equal magnetic flow employed.

This condition of resonance achieved in a variable manner and with variable parameters along the longitudinal extent of the crystalliser generates a better condition for separation of the skin from the sidewalls of the crystalliser and an easier and faster downward sliding of the metal.

In this way the generation of those vibrations amplified by the condition of resonance reproduces, in an improved form, at least partly by an electromagnetic method the mechanical oscillation of the mould suitable to make easier the descent of the molten metal within the crystalliser.

In the event of a multi-phase system the intensity of the electromagnetic forces can be locally two to three times that which can be obtained with a single-phase system.

This condition makes it possible, where necessary, to obtain between the coil and the sidewall of the crystalliser a distance enough for the passage of the cooling liquid, thus avoiding the problem of bringing the current to a position in the immediate vicinity of the crystalliser, and also enables a lower power to be employed to get the same effects, given an equal distance between the coil and the sidewall of the crystalliser.

The ability to be able to control the force exerted by each single electromagnetic device on the cast product both in intensity and in frequency of application enables the parameters of solidification of the skin at various positions along the crystalliser to be controlled.

In particular, by controlling the electromagnetic forces along the crystalliser it is possible to control the effect of those forces on the skin of the cast product, thus reducing the friction between the solidified skin and the sidewalls of the crystalliser.

The heat exchange between the cast metal and the solidified skin is increased due to the vibration which is created in the mushy zone by means of the opportune frequencies of the pulses according to the spirit of the invention. Moreover, with this invention, by controlling the frequency of application of the force on the solid skin, it is possible to manage the heat exchange with the crystalliser.

In the zone of the meniscus, it is therefore possible to reduce the heat exchange according to the type of steel and the casting speed and consequently to improve the quality of the product.

In the lower part it is therefore possible to increase the heat exchange and consequently increase the total amount of heat removed from the cast product; it is thus possible to increase the casting speed.

According to a variant at least some electromagnetic devices can be moved in relation to an axis parallel to the direction of casting of the steel so as to optimise the position of those devices from time to time, according to the different casting conditions (for instance, speed and type of steel).

According to the invention the electromagnetic devices make possible the formation of volumetric waves (i.e., waves which cause the shifting of a volume of the molten metal) on the surface of the meniscus according to two possible developments.

In a first solution an almost stationary volumetric wave is generated at the meniscus and enables a gap of a substantially fixed dimension to be formed. The gap depends on the intensity of the electromagnetic force generated and is formed between the skin just solidified and the sidewalls of the crystalliser; it enables a lubricant (oil and/or powders) to be introduced and makes the introduction uniform.

According to a variant a progressive wave is generated which is displaced towards the centre and causes a periodical separation of the solidified skin from the crystalliser, thus determining a sort of "pump effect" (i.e., the effect obtained by the progressive wave toward the center of the crystalliser); this separation enables the lubricant to be introduced periodically and makes the introduction uniform.

This periodical movement also causes a movement of the gases at a supersonic speed in the local atmosphere, and the movement of the gases causes an increase of the heat exchange.

This situation enables the heat exchange to be controlled in the first important zone of solidification of the skin.

The system according to the invention also makes possible an efficient action of stirring which, since it is in a vertical direction, is not the traditional stirring, that is to say, a magnetic field perpendicular to the product and migrating along the axis of the crystalliser, but a series of squeezing pulsations in the cast material which take place at different times and in different positions along the crystalliser; these pulsations are such as to cause a real global movement (i.e., an effective movement caused by the pulsation which affects the entire liquid part of the material) in the liquid part of the material.

The combination of all the advantages provided by the invention may make possible the performance of castings without using any mechanical oscillation of the crystalliser. According to a variant, it is possible not to use oil or lubricant powders which can only have the purpose of protecting the free surface of the meniscus.

According to the invention electromagnetic forces of a greater intensity are generated in the lower part of the crystalliser than those generated in the upper part of the crystalliser.

The electromagnetic waves generated by the electromagnetic devices are obtained by means of pulses of current which, with the devices positioned in the lower part of the crystalliser, reach an intensity of up to 100 kA.

According to one embodiment of the invention these pulses may have a progressively retarded development (i.e., a development which progressively varies in a delayed manner), for instance starting from the top of the crystalliser, so that the field produced takes on a configuration of sequences built-up on each other with a progressively increasing intensity.

Each of these pulses has a duration contained within a half-period; these pulses may also have a substantially regular development with an ascending segment followed by a descending segment or else an irregular development comprising a plurality of peaks of a variable amplitude.

According to the invention the sidewalls of the crystalliser, where they have the structure of plates, are separated from each other by electrically insulating elements which prevent interference between electromagnetic devices acting in cooperation with the specific sidewalls of the crystalliser.

The electric insulation between the different plates serves to allow a more efficient penetration of the magnetic fields inside the cast product as shown (the same phenomenon which forms the basis of the "Cold Crucible"). Moreover, the invention provides coils which cooperate externally with all four plates of the crystalliser.

According to a variant the inner surface of the plates is lined with a thin electrically insulating layer consisting, for instance, of $Br_2C+Al_2O_3$ or only $Al_2O_3$ or AlN or amorphous diamond carbon.

The electromagnetic devices may be positioned within the channel feeding the cooling liquid and are therefore cooled on at least three sides, or else are merely facing that channel.

Where the crystalliser consists of plates, the cooling channels are advantageously made within those plates; in this case, the electromagnetic devices may be positioned directly in contact with the outer surface of the plates after interposition of an electrically insulating element.

The electromagnetic devices may also consist of drilled wire or have their own personalised cooling conduit so as to be individually cooled.

According to a variant of the invention means to convey and concentrate the electromagnetic field are included on the sidewall of the crystalliser in a position facing each electromagnetic device and are suitable to prevent dispersions and weakening of the electromagnetic field.

The greater the distance between the electromagnetic devices and the cast metal, for instance where the electromagnetic devices are located on the outer walls defining the outer cooling channel, the more important are those conveying and concentration means.

BRIEF DESCRIPTION OF THE DRAWINGS

The attached figures are given as a non-restrictive example and show some preferred embodiments of the invention as follows.

DETAILED DESCRIPTION OF THE PREFERRED EMBODIMENTS

Figure 2:
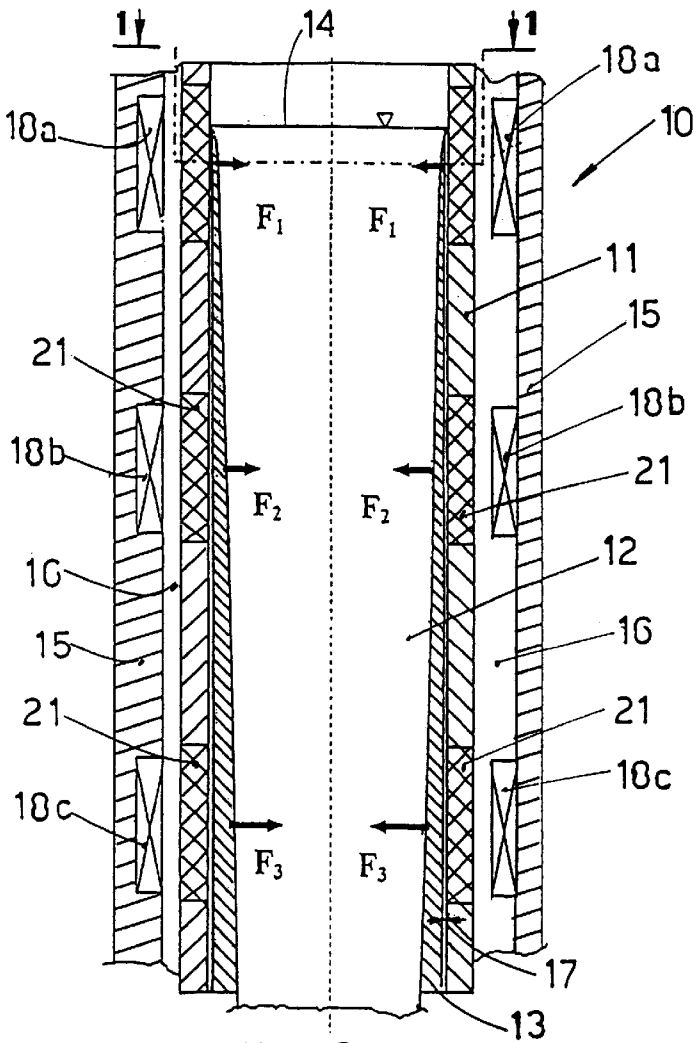
FIG. 2 shows a variant of FIG. 1.
Figure 1:
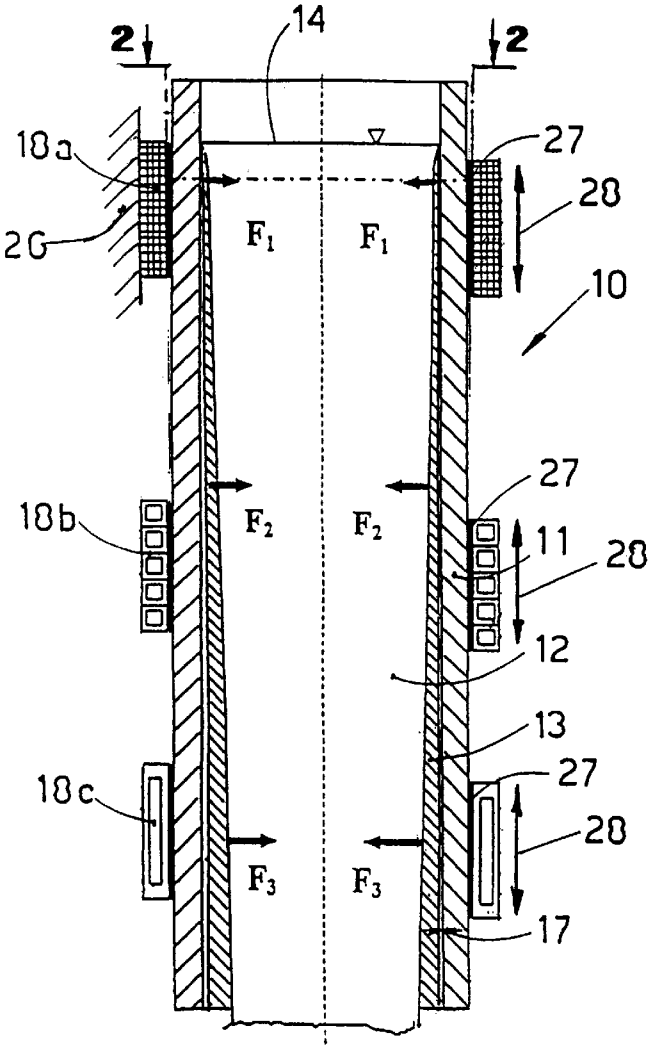
FIG. 1 shows a longitudinal section of a first form of embodiment of a crystalliser associated with electromagnetic devices performing the method according to the invention.

FIGS. 1 and 2 show partial diagrams of a longitudinal section of a crystalliser 10 with sidewalls 11 for the continuous casting of billets, blooms or slabs.

The molten metal 12 cast in the crystalliser 10 becomes progressively solidified and forms an outer shell of solidified skin 13 having a growing thickness starting from the meniscus 14 and increasing to the outlet of the crystalliser 10.

This outer shell of solidified skin 13 defines a distance or gap 17 between itself and the relative sidewall 11 of the crystalliser 10, the value of the gap 17 increasing progressively towards the outlet of the crystalliser 10.

Figure 18A:
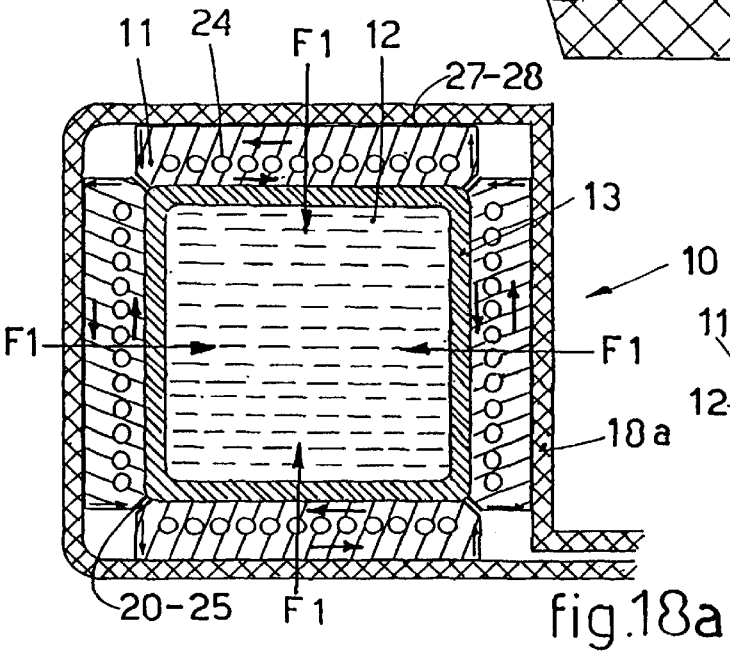
FIGS. 18*a* and 18*b* show two variants of FIG. 5.
Figure 18B:
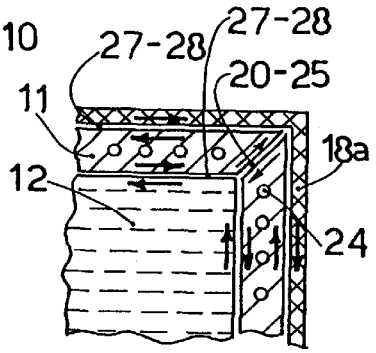

At least where the crystalliser 10 is of a tubular type or of a like type, walls 15 are included outside the sidewalls 11 of the crystalliser 10 and define a channel 16 of a very small width in which there flows the cooling liquid (FIG. 2); the circulation of this liquid carries out the step of primary cooling and solidification of the cast product within the crystalliser 10.

Where the crystalliser 10 is of a type consisting of plates, the cooling channels 16 are provided within the plates themselves, thus enabling the cooling liquid to be brought to a position very close to the cast metal and therefore improving the efficiency of the cooling (FIGS. 1 and 18).

In this case, on the periphery of the sidewalls 11 of the crystalliser 10 and spaced apart along the length thereof, there is a plurality of electromagnetic devices 18; in the case of the Figures there are three in number, referenced with 18*a*, 18*b* and 18*c*.

The electromagnetic devices 18 are suitable to generate a pulsating electromagnetic field migrating into the molten metal 12 in the crystalliser 10, with a resulting formation of electromagnetic forces which interact with the cast metal.

These electromagnetic forces, depending on the slope of the pulse and on the self-inductance of the system, may be oriented towards the inside of the crystalliser 10 or towards the outside thereof.

The forces generated by the various electromagnetic devices 18*a*, 18*b*, 18*c* may all be oriented in the same direction or be alternated according to any combination according to the specific requirements.

The electromagnetic devices 18*a*, 18*b*, 18*c* can be configured to generate forces in one direction at one momentary instant and forces in the opposite direction in the successive momentary instant in such a way as to generate a pulsating or pump effect.

The electromagnetic devices 18*a*, 18*b*, 18*c* are configured in a desired differentiated manner and/or are fed in a differentiated but mutually correlated manner so as to provide an overall pulsating electromagnetic field migrating along the crystalliser 10 and suitable to ensure the achieving of a plurality of desired actions on the solidifying metal.

In particular, the electromagnetic field generated has the purpose of causing conditions at least very close to the condition of resonance in the cast metal within the crystalliser 10.

In the example of FIG. 1 the electromagnetic devices 18*a*, 18*b*, 18*c* are secured to the outer surface of the sidewall 11 of a crystalliser 10 of a type formed with plates and include inner cooling means.

An electrically insulating layer 27, which may also consist of a slender thickness of air or of a specific material, is included between each electromagnetic device 18*a*, 18*b*, 18*c* and the sidewall 11 of the crystalliser 10.

The electromagnetic devices 18*a*, 18*b*, 18*c*, so as to avoid deformations which might lead to their damage, are associated with rigid supports 26 which make possible the discharge of the force of counterreaction which reacts against the electromagnetic force, in this case F1, generated towards the inside of the crystalliser 10.

In the example of the righthand part of FIG. 2 the electromagnetic devices 18*a*, 18*b*, 18*c* are associated with a crystalliser 10 of a tubular type or like type; in this case the electromagnetic devices 18*a,* 18*b,* 18*c* are positioned within the cooling channel 16, are secured to the inner surface of the outer wall 15*b* of that channel 16 and cooperate on three sides with the cooling liquid.

In the example of the lefthand part of FIG. 2 the electromagnetic devices 18*a,* 18*b,* 18*c* are inserted in the outer walls 15 of the channel 16 and have only one side facing the cooling channel 16.

The electromagnetic devices 18*a,* 18*b,* 18*c* are fed in such a way as to generate a series of periodical electromagnetic pulses having a duration contained within a half-period.

Figure 4:
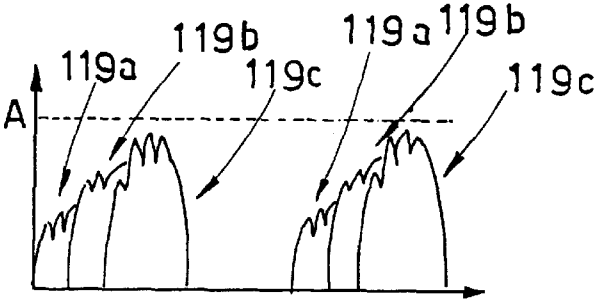
FIG. 4 shows a variant of FIG. 3.
Figure 3:
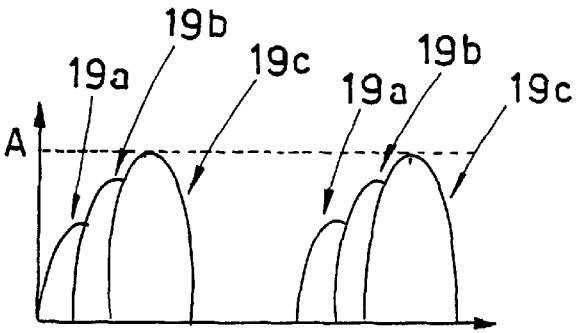
FIG. 3 shows a graph of the development of the electromagnetic fields generated by the devices of FIGS. 1 and 2.

Possible configurations of the feed are shown in FIGS. 3 and 4.

In this case it is possible to see how the development of the migrating field is such as to obtain a configuration of sequences building up on each other between the three electromagnetic devices 18*a,* 18*b,* 18*c,* whereby there is a migration of the field starting from the top of the crystalliser 10 downwards with a progressively increasing intensity of the pulses.

The pulses referenced with 19*a,* 119*a* relate to the device 18*a,* while those referenced with 19*b,* 119*b* relate to the device 18*b* and those referenced with 19*c,* 119*c* relate to the device 18*c*.

Preferred values of the pulses 19 provide for a maximum intensity I equal to 100 kA, a maximum duration of pulse tl between 0.02 and 1 ms and a frequency between 5 and 100 Hz.

In the case shown in FIG. 3 the pulse 19*a,* 19*b,* 19*c* has a substantially regular development, and includes a regular ascending side followed by a regular descending side.

In the case of FIG. 4 each single pulse 119*a,* 119*b,* 119*c* has a development pulsating in turn and includes a consecutive plurality of peaks of a limited duration.

This configuration the electromagnetic devices 18*a,* 18*b,* 18*c* leads to the generation of pulsating electromagnetic forces FI, F2, F3 of a progressive increasing intensity, starting from the top of the crystalliser 10.

These forces FI, F2, F3 generate in the molten metal 12 and in the solidifying skin 13 a desired action of vibration which restricts the problems of the skin adhering to the sidewalls 11 of the crystalliser 10 and facilitates the downward sliding of the cast product.

The electromagnetic forces FI, F2, F3 may all be directed in the same direction (FIG. 2), or may have alternate directions (FIG. 1) or else may have a development momentarily alternated in one direction and the other.

This is particularly useful at the meniscus position, since the pumping effect makes the lubrification action more active.

The combination of the parameters of the feeding and arrangement of the electromagnetic devices 18*a,* 18*b,* 18*c* makes also possible the achievement of a condition at least as close as possible to that of resonance along the whole longitudinal extent of the crystalliser 10; this condition, by amplifying the value of the vibrations, increases their effectiveness, given an equality of the feeding parameters and of the number and size of the electromagnetic devices and of the distances and thicknesses, etc.

In this case, the sidewalls 11 of the crystalliser 10 of a type consisting of plates (FIG. 1) are separated from each other by electrically insulating elements 20, which prevent interferences between the actions of the electromagnetic devices 18*a,* 18*b,* 18*c* positioned on the specific sidewalls 11 of the crystalliser 10.

Possible examples, which refer to different configurations of the cross-section of the crystalliser 10 are shown in FIGS. 5, 6, 7, 8, 11, 12 and 18.

Figure 11:
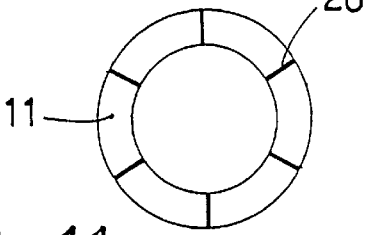
FIGS. 11 and 12 show further variants of FIG. 5.
Figure 12:
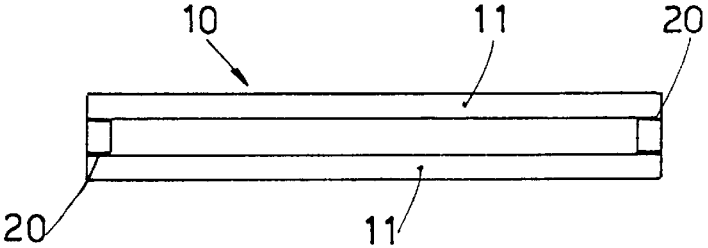
Figure 10:
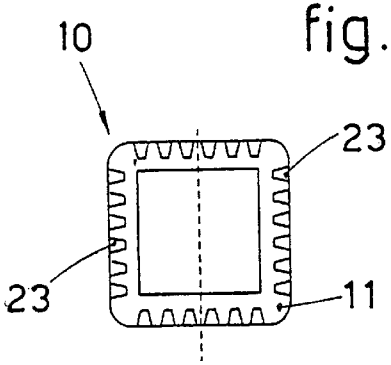
FIG. 10 shows a variant of FIG. 9.
Figure 9:
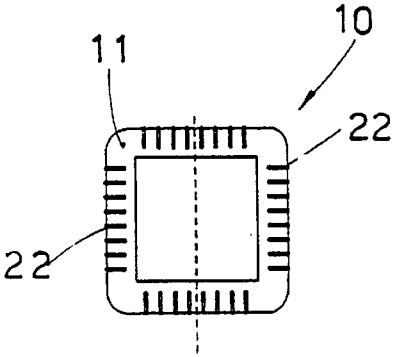
FIG. 9 shows a cross-section along the line B—B of FIG. 2.
Figure 16:
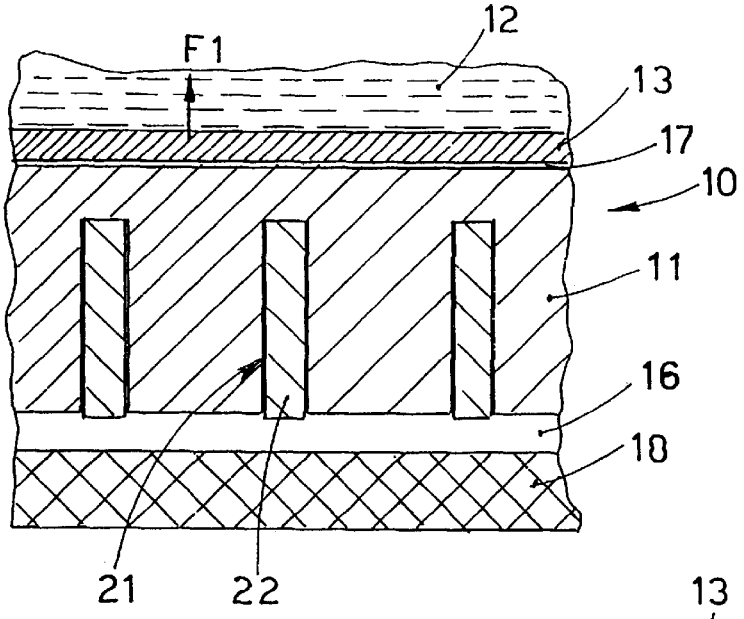
FIG. 16 shows an enlarged detail of FIG. 9.
Figure 17:
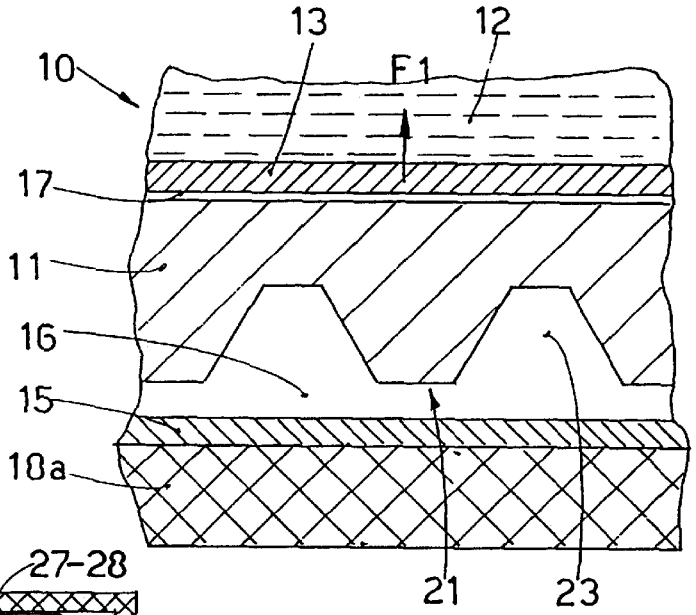
FIG. 17 shows an enlarged detail of FIG. 10.

FIGS. 11 and 12 show variants of the crystalliser 10 with a circular cross-section for the production of round bars and with a rectangular cross-section for the production of slabs respectively, these variants being equipped with electrically insulating connecting elements 20.

In FIG. 2 means 21 to convey and concentrate the electromagnetic field are included in positions facing the electromagnetic devices 18*a,* 18*b,* 18*c* and in cooperation with the relative sidewalls 11 of the crystalliser 10 and have the purpose of preventing dispersions and weakening of the field in the travel of the electromagnetic waves to the molten metal 12 in view of the relative long distance between the electromagnetic devices 18*a,* 18*b,* 18*c* and the molten metal 12.

In the example shown in FIGS. 9, 10, 16 and 17, which concern a crystalliser 10 of a tubular type, these conveying and concentrating means 21 consist of inserts 22 or prismatic notches 23 machined in the outer side of the sidewalls 11 of the crystalliser 10 to a height at least equal to the longitudinal extent of the relative electromagnetic devices 18*a,* 18*b,* 18*c*.

The prismatic notches 23 also enable the cooling fluid to be brought, closer to the cast metal 12.

Figure 15:
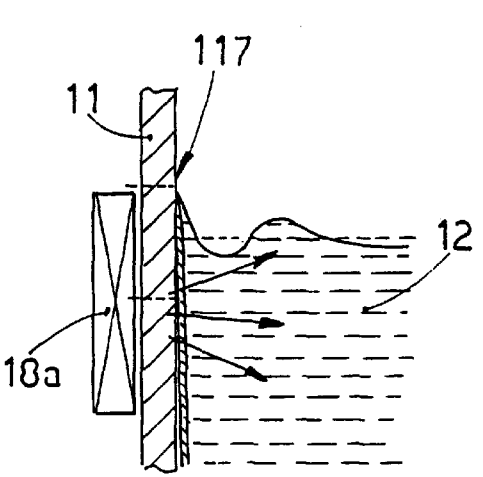
FIGS. 14 and 15 show a variant of FIG. 13 in two separate working steps.
Figure 14:
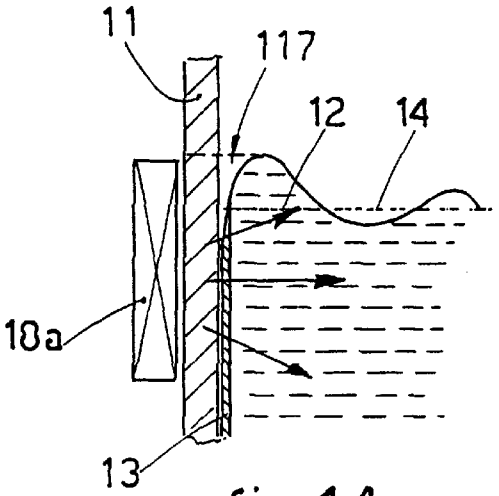
Figure 13:
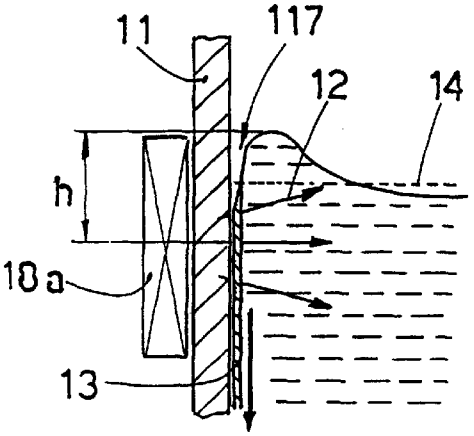
FIG. 13 shows a detail of FIG. 2.

FIGS. 13, 14 and 15 show two possible effects which can be achieved on the meniscus 14 with the device according to the invention.

In a first solution shown in FIG. 13 an almost stationary volumetric wave is generated at the meniscus 14 and enables a gap, 117 to be formed of a substantially stationary size between the skin 13 just solidified and the sidewall 11, this gap 117 making possible the introduction of a lubricant.

According to the variant shown in FIGS. 14 and 15 a progressive volumetric wave is generated which is displaced on the meniscus 14 towards the centre, thus causing a periodical separation of the solidified skin 13 from the crystalliser 10, this separation enabling a lubricant to be introduced periodically.

So as to improve the cooling of the crystalliser 10 and to enable the electromagnetic devices 18*a,* 18*b,* 18*c* to be brought as close as possible to the cast metal, as shown in FIG. 18, a crystalliser 10 of a type consisting of plates is cooled by a fluid which runs along longitudinal channels 24 provided within the sidewalls 11 of the crystalliser 10.

Figure 8:
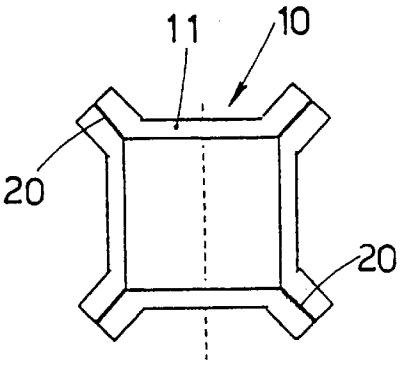
FIGS. 6 7 and 8 show possible variants of FIG. 5.

The joint between the sidewalls 11 of the crystalliser 10 can be obtained, as in the example of FIG. 8, by the application of screws at the corners.

Figure 7:
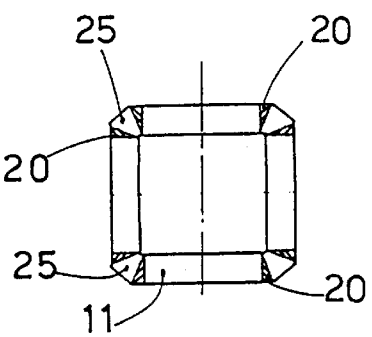
Figure 6:
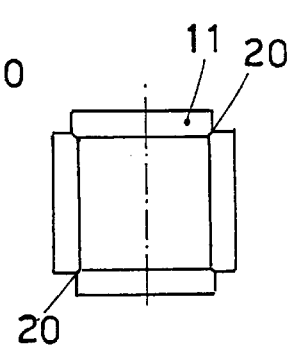
Figure 5:
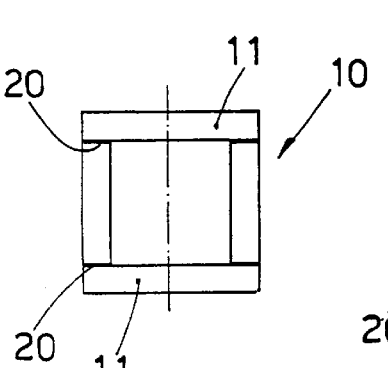
FIG. 5 shows a partial cross-section along the line A—A of FIG. 1.

In the example of FIG. 7 the sidewalls 11 are joined together by steel inserts 25, which ensure good rigidity and sufficient electrical insulation.

The electromagnetic devices 18*a,* 18*b,* and 18*c* can be moved in the direction 28 parallel to the sidewalls 11 even during the casting stage, so as to adapt the method to the different conditions which occur during the cycle.

Layers of air or electrically insulating material 28 may be included.

According to the invention, the electromagnetic devices 18*a,* 18*b,* 18*c* are cooled by means of cooling fluid circulating inside.

We claim:

1. Device for the continuous casting of billets, blooms, slabs and round bars, which is associated with a crystalliser containing the cast metal and including sidewalls cooperating with cooling channels defined by outer walls, the device comprising a plurality of electromagnetic devices located outside the sidewalls, the electromagnetic devices being directly cooperating with the sidewalls and spaced apart longitudinally along the direction of sliding of the cast product, the electromagnetic devices being configured and fed in a differentiated manner so as to generate a pulsating electromagnetic field generating forces in a substantially perpendicular direction to the longitudinal axis of the crystalliser, the pulsating electromagnetic field migrating substantially along the whole longitudinal extent of the crystalliser, with the current pulses reaching a value of up to 100 kA.

2. Device as in claim 1, in which each electromagnetic device is provided adjacent at least one relative plate or sidewall of a crystalliser consisting of plates.

3. Device as in claim 1, in which the electromagnetic devices are secured to the outer surface of the sidewalls of the crystalliser, an electrically insulating layer being included between the electromagnetic devices and the relative sidewalls.

4. Device as in claim 4, in which the electromagnetic devices are cooled by the internal circulation of a cooling fluid.

5. Device as in claim 1, in which the electromagnetic devices are secured to inner surfaces of outer walls defining the cooling channels and cooperate with the cooling liquid on three sides.

6. Device as in claim 1, in which the cooling channel is provided outside the outer walls and the electromagnetic devices are inserted into outer walls of the crystalliser and have one side facing the cooling channel.

7. Device as in claim 1, in which the electromagnetic devices are movable along the casting direction.

8. Device as in claim 1, in which concentrating devices to convey and concentrate the electromagnetic field are included in cooperation with the sidewall of the crystalliser and adjacent the electromagnetic devices and have a longitudinal length at least equal to a longitudinal length of the relative electromagnetic device.

9. Device as in claim 1, in which the sidewalls of the crystalliser are separated from each other by electrically insulating elements.

10. Device as in claim 1, in which the inner surface of the sidewalls of the crystalliser is lined with an electrically insulating layer.

11. Device as in claim 1, in which the electromagnetic devices secured to the sidewalls of the crystalliser cooperate at least on their opposite side with rigid supports.

12. Method for the continuous casting of billets, bloom, slabs, round rods and other products in association with a crystalliser containing the cast metal and comprising sidewalls cooperating with cooling channels defined by outer walls, the method comprising feeding a plurality of electromagnetic devices spaced longitudinally along the extent of the crystalliser with differentiated current pulses which achieve a value of up to 100 kA to generate a pulsating magnetic field, and applying the pulsating magnetic field to the solidified skin of the cast metal within the crystalliser to generate forces in a direction substantially perpendicular to the longitudinal axis of the crystalliser, the pulsating magnetic field migrating in the direction of the longitudinal axis along substantially the whole extent of the crystalliser.

13. Method as in claim 12, in which at least one of the electromagnetic devices is fed with parameters of intensity and frequency of the current so as to induce a condition as close as possible to the local condition of resonance in the specific zone of the crystalliser to generate forces.

14. Method as in claim 12, in which the electromagnetic field generated by the electromagnetic devices (18*a*, 18*b*, 18*c*) in a zone in which the metal has at the same time a liquid phase and a solid phase is such as to excite the frequencies of resonance in a field between about 10 KHz and about 30 KHz.

15. Method as in claim 12, in which the electromagnetic field generated by the electromagnetic devices in a zone in which the metal has a consistent solidified skin is such as to excite the frequencies of resonance in a field between about 1 KHz and about 10 KHz.

16. Method as in claim 12, in which the electromagnetic field generated by the electromagnetic devices in the zone of oscillation of a free surface is such as to excite the frequencies of resonance in a field between about 5 Hz and about 70 Hz.

17. Method as in claim 12, in which the electromagnetic devices produce in the cast metal a stirring action of an intensity and frequency which differ along the length of the crystalliser.

18. Method as in claim 12, in which the electromagnetic field generated by the electromagnetic devices produces at the meniscus a stationary volumetric wave of an intensity such as to define a gap of a substantially fixed amplitude between the skin just solidified and the sidewalls of the crystalliser.

19. Method as in claim 12, further comprising controlling the electromagnetic field generated by the electromagnetic devices to produce at the meniscus pulsating volumetric waves which progress towards the centre of the crystalliser such as to cause a periodical separation of the skin just solidified from the sidewalls with a pump effect.

20. Method as in claim 12, in which the electromagnetic waves generated by the electromagnetic devices are generated by pulses which have a progressively delayed development, in a lengthwise direction to the crystalliser, in such a way as to assume a following configuration with an intensity which grows towards the outlet of the crystalliser.

* * * * *